US005263655A

United States Patent [19]

Giammaruti et al.

[11] Patent Number: 5,263,655

[45] Date of Patent: Nov. 23, 1993

[54] COAL PULVERIZER

[75] Inventors: Robert J. Giammaruti, North Canton; Thomas L. Henning, Massillon; Andrew E. Jackson; Noel S. Moen, both of Uniontown, all of Ohio

[73] Assignee: The Babcock & Wilcox Company, New Orleans, La.

[21] Appl. No.: 33,067

[22] Filed: Mar. 10, 1993

Related U.S. Application Data

[63] Continuation of Ser. No. 858,255, Mar. 26, 1992, abandoned.

[51] Int. Cl.[5] ..... B02C 15/00

[52] U.S. Cl. ..... 241/119; 241/121

[58] Field of Search ..... 241/80, 97, 119, 121

[56] References Cited

U.S. PATENT DOCUMENTS

| | | | |
|---|---|---|---|
| 2,275,595 | 3/1942 | Schwartz | 241/103 X |
| 2,378,681 | 6/1945 | Bailey et al. | 241/103 X |
| 2,473,514 | 6/1949 | Ebersole | 241/103 X |
| 2,545,254 | 3/1951 | Bice | 241/103 X |
| 4,264,041 | 4/1981 | Kitto, Jr. et al. | 241/103 X |
| 4,602,745 | 7/1986 | Maliszewski et al. | 241/119 |
| 4,605,174 | 8/1986 | Maliszewski et al. | 241/119 X |
| 4,687,145 | 8/1987 | Dougan et al. | 241/119 X |
| 4,721,258 | 1/1988 | Dougan et al. | 241/119 X |
| 4,752,037 | 6/1988 | Farris et al. | 241/119 X |
| 5,020,734 | 6/1991 | Novotny et al. | 241/119 |

FOREIGN PATENT DOCUMENTS

| | | | |
|---|---|---|---|
| 264103 | 4/1988 | European Pat. Off. | 241/119 |
| 3344223 | 6/1985 | Fed. Rep. of Germany | 241/119 |
| 264156 | 1/1989 | German Democratic Rep. | 241/119 |
| 587989 | 1/1978 | U.S.S.R. | 241/119 |
| 1094617 | 5/1984 | U.S.S.R. | 241/121 |

*Primary Examiner*—Mark Rosenbaum
*Assistant Examiner*—Frances Chin
*Attorney, Agent, or Firm*—Daniel S. Kalka; Vytas R. Matas; Robert J. Edwards

[57] ABSTRACT

An improved annular passage arrangement for a pulverizer includes vertically extending inner and outer passage walls which define the annular passage divided by vanes extending at an acute angle to the horizontal. The annular passage is divided into a plurality of passage ports and a low pressure drop is experienced as compared to the prior art passage arrangements. The inner and outer passage walls may be connected to each other and rotate together with the vanes and the vanes are advantageously shorter in length then was conventional for further reducing pressure drop.

12 Claims, 4 Drawing Sheets

COAL PULVERIZER

This is a continuation of application Ser. No. 07/858,255, filed Mar. 26, 1992 abandoned.

BACKGROUND OF THE INVENTION

1. Field of the Invention

The present invention relates in general to pulverizers for pulverizing coal, and in particular to a new and useful annular passage design for such pulverizers which has an improved low pressure drop characteristic.

2. Description of the Related Art

One type of known coal pulverizing mill (pulverizer) is a slow speed, roll-and-race-type pulverizer that uses three large-diameter grinding rolls to crush the coal. Primary air enters the pulverizer through a radial inlet duct, moves into a low-velocity air plenum, and is then accelerated and oriented by a series of stationary passages in a ring that surrounds the grinding zone. At the outlet of the passage, the pulverized coal particles are entrained by the high-speed airflow. The velocity of the air is then reduced in the main pulverizer housing causing the larger particles to be returned directly to the grinding zone for further crushing, while the smaller particles are carried up through the classifier for final sizing.

A large portion of the primary air pressure drop is due to losses across this annular passage. In some known pulverizers, the primary air pressure drop can be about 40% higher than other mills containing different, annular passage designs. Due to this higher pressure drop, more fan power is required to operate the mill. This results in a large power penalty due only to the annular passage design.

A known design illustrated in FIGS. 1 and 2, is a modified version of the earlier stationary annular passage design of the early 1980's. This design consists of forty-two passage ports (10) made up of fourteen separate castings mounted to the top and bottom of a grinding table (16). The annular passage is divided into the individual passage ports (10) through the use of flow vanes (12). The vanes extend from the annular passage inlet (10*a*) to the annular passage outlet (10*b*) and are included at an angle (14) of 30° from the horizontal and an angle (18) of 15° from the vertical toward the grinding zone (20). The outer annular passage wall (22) is stationary while the remainder of the annular passage including its inner wall (24) and the vanes (12) is rotated with the grinding table (16). The air flow is initially oriented by a tear-drop shape (12*a*) at the leading edge of the vane (12) and is accelerated to promote a uniform velocity profile over an airfoil shape (12*b*) on a portion of the upper surface. Table (16) rotates within a housing (6), about a vertical axis. Wall (22) is supported in the housing and the housing encloses the grinding zone (20). The function of the vanes is to accelerate and orient the flow through the annular passage as described in U.S. Pat. No. 4,264,041.

Other pertinent existing prior art relating to pulverizer passage designs are U.S. Pat. No. 2,275,595 (Schwartz '595); U.S. Pat. No. 2,378,681 (Bailey, et al '681); U.S. Pat. No. 2,473,514 (Ebersole '514); and U.S. Pat. No. 2,545,254 (Bice '254), all of which are assigned to The Babcock & Wilcox Company. Schwartz '595, discloses curved annular passages fanning a annular passage discharging scavenging air in the direction of the grinding elements. Bailey, et al '681, discloses a design for constant air velocity through the annular passage. Ebersole '541, discloses an adjustable annular passage, and Bice '254, discloses an eccentric passage design for air distribution.

SUMMARY OF THE INVENTION

The present invention involves an improved annular passage design which has substantially less pressure drop across it. The reduction in pressure drop is achieved by creating a more uniform velocity distribution across the annular passage. This is accomplished by redesigning how the primary plenum air enters, travels through, and exits each passage port. By creating a more uniform velocity distribution, the overall velocity level may be reduced since regions of low velocity along the passage need not be compensated for. This results in a velocity pressure drop reduction across the entire annular passage.

An object of the invention is to redesign particular areas of the existing annular passage to take advantage of existing flow-contouring techniques. The invention includes five design improvements, each one incorporating a particular pressure-reducing idea. The improvements may be utilized individually, in particular groups, or in total to obtain the desired pressure drop performance.

Accordingly, a further object of the present invention is to provide an annular passage arrangement for a pulverizer, comprising: a fixed housing having an axis and defining an inlet plenum for air into the pulverizer and a grinding zone where air picks up and conveys articles pulverized in the pulverizer; a grinding table mounted for rotation about the axis in the housing; an outer wall in the housing; an inner wall connected to the table and positioned in the housing, the inner wall being spaced inwardly of the outer wall for defining an annular passage therebetween; a plurality of vanes extending radially between the inner and outer walls for dividing the passage space into a plurality of circumferentially spaced passage ports between the inner and outer walls; and the inner and outer walls both being substantially parallel to the axis.

Yet a further object of the present invention is to provide the vanes at a reverse acute angle with respect to the prior art.

A still further object of the present invention is to provide flow-contouring plates at an inner part of the inlet for each port for contouring air entering each port.

A still further object of the present invention is to attach the outer passage wall to the inner passage wall through the vanes so that the inner and outer walls as well as the vanes rotate around the axis. Another feature of the present invention is that each vane is shorter than the prior art vanes for further reducing pressure drop and improving air flow.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
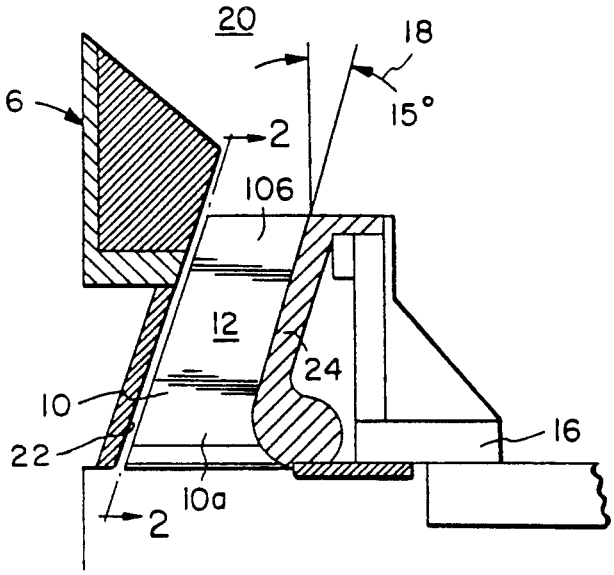
FIG. 1 PRIOR ART
FIG. 1 is a vertical section view of the passage area for a known air-swept pulverizer or mill.
Figure 2:
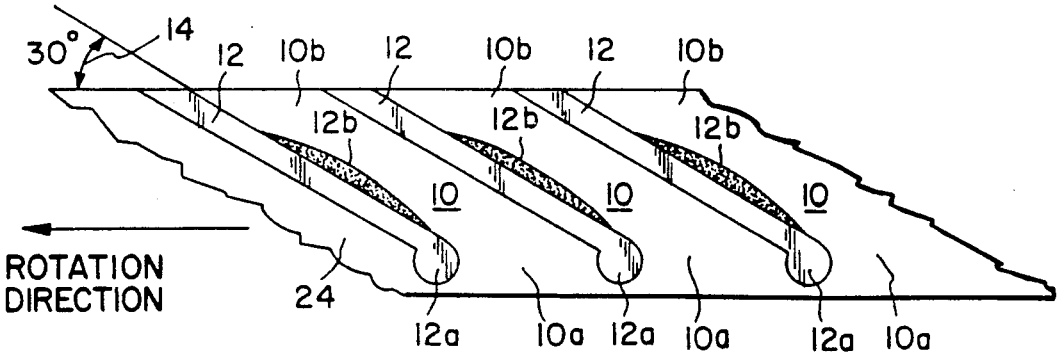
FIG. 2 PRIOR ART
FIG. 2 is a vertical elevational view taken along line 2—2 of FIG. 1.

In FIGS. 3 to 8, the same reference numerals are utilized as those used in FIGS. 1 and 2 for the same or functionally similar parts.

Figure 3:
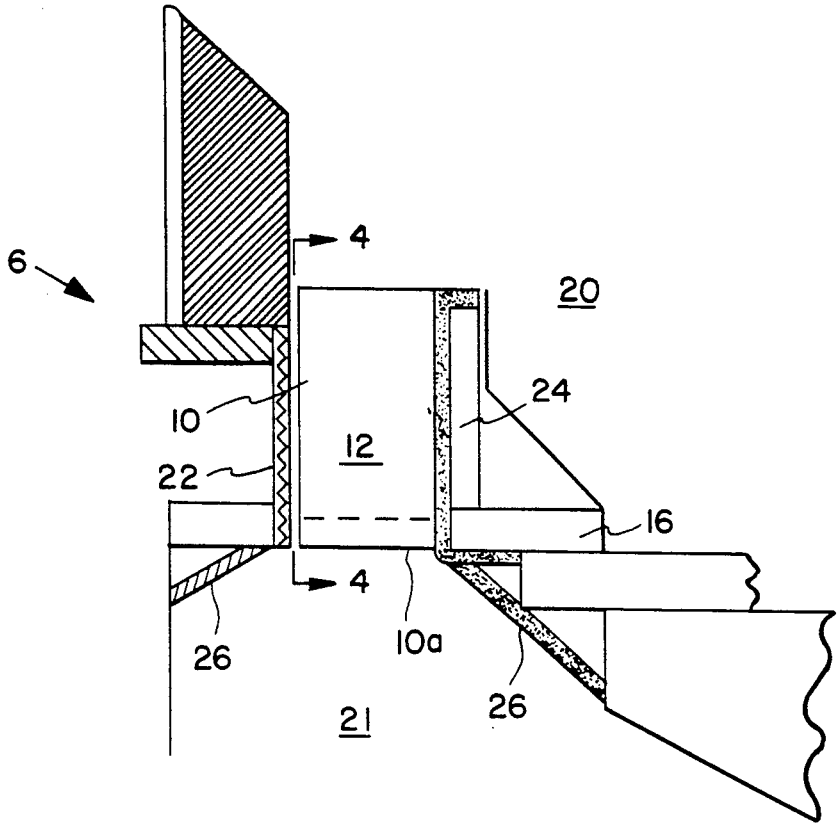
FIG. 3 is a view similar to FIG. 1 of the annular passage area of a pulverizer or mill, constructed according to the present invention.
Figure 4:
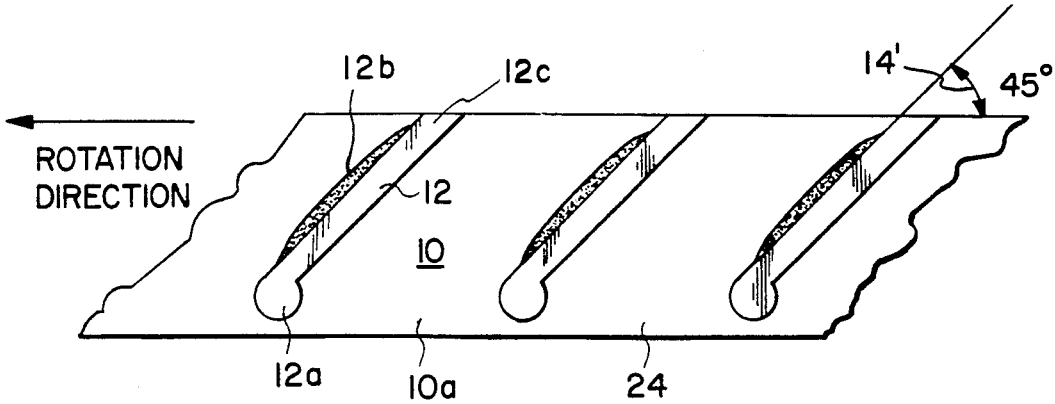
FIG. 4 is a vertical elevation taken along line 4—4 of FIG. 3.

Referring now in particular to FIGS. 3 and 4, the invention embodied therein comprises an annular passage arrangement for a pulverizer having a fixed housing (6) with a central axis (not shown). Grinding table (16) rotates around the central axis for pulverizing particles, in particular coal, in a conventional fashion. Grinding table (16) rotates in the rotation direction indicated by the arrow in FIG. 4. Air supplied to an inlet plenum (21) travels upwardly through the annular passage provided between an outer passage wall (22) and an inner passage wall (24). The passage space is further divided into individual passage ports (10) by vanes (12), distributed in a circumferentially spaced manner around the vertical axis of the pulverizer. As best shown in FIG. 3, one novel feature of the present invention is that both the outer and inner throat walls (22, 24) are vertical, that is parallel to the rotation axis, rather than being at an angle to the axis as in the prior art (see angle 18 in FIG. 1).

Another novel feature of the present invention is that, unlike the prior art as shown in FIG. 2, each vane (12) is at an acute angle (14') to the horizontal which is advantageously but not necessarily about 45°, in a direction so that the inlet end (12*a*) of each vane is upstream of the outlet end (12*c*) of each vane with respect to the rotation direction of the grinding table (16). This is reversed from the angular orientation of the prior art as shown at angle (14) in FIG. 2. Vanes (12) continue to have the upstream or leading edge (12*a*) which is teardrop shaped and the intermediate air foil shape (12*b*), but both are reversed in orientation with respect to the rotation direction and as compared with the prior art.

In the embodiment illustrated in FIGS. 3 and 4, vanes (12) are fixed to and extend radially outwardly of the inner passage wall (24) with a clearance being provided between the outer edge of each vane, and the outer passage wall (22).

Another novel feature of the present invention illustrated in FIG. 3 is the use of flow-contouring plates (26) extending at an acute angle, for example about 45° with respect to the vertical axis, along the inner periphery of the entry area for ports (10) within the inlet plenum (21).

The advantages of a vertical inner and outer passage wall are, first, the passage inlet is moved away from the pulverizer outer wall. This will reduce any wall effects, such as recirculation zones which may obstruct or disturb the inlet airflow. Secondly, this results in a redirection of the passage outlet airflow away from the grinding table (16). This will reduce any flow obstruction due to the pulverizer wheel hubs and provide for a more uniform and dilute coal bed.

Changing the vane to a reverse 45° angle and orientation will a) enable the lowering of the average passage velocity as more of the vertical (y) component of velocity is used to suspend the entrained coal particles; b) reduce the energy expended on swirling or rotating the coal bed by lowering the horizontal (x) component of velocity; and c) take advantage of the upward fanning effect produced by the annular passage rotation. Currently, the vane orientation now used in FIG. 2, blows a portion of the mill air downwardly, adding to the pressure drop.

The addition of flow-contouring plates (26) below the passage inlet (10*a*) will help eliminate recirculation zones resulting from sharp corners or step changes in this area of the mill plenum. Elimination of these flow disturbances will help create a more uniform flow pattern up and into the passage inlet.

Figure 5:
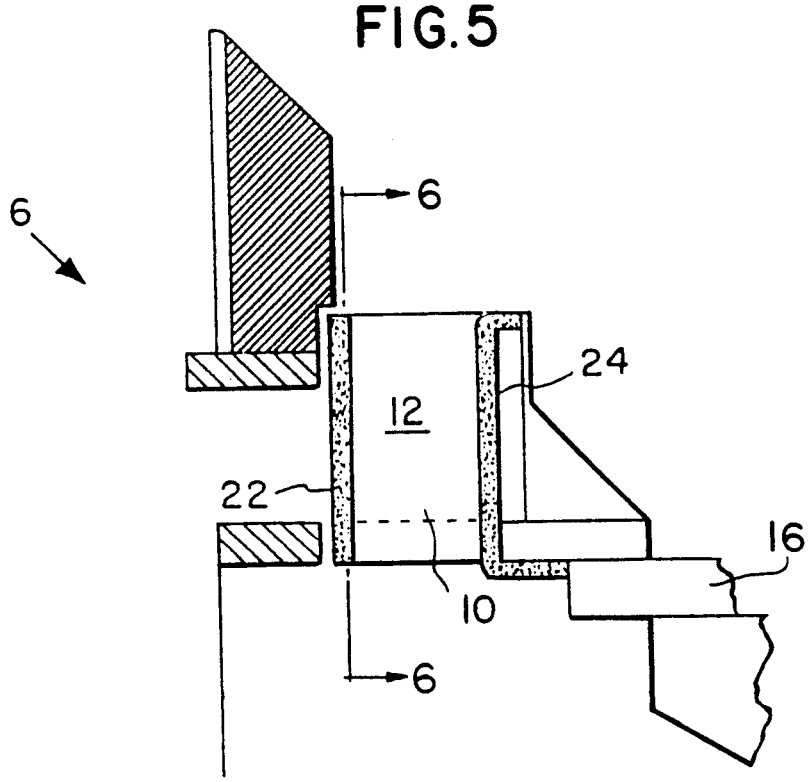
FIG. 5 is a view similar to FIG. 3 showing further features of the present invention.
Figure 6:
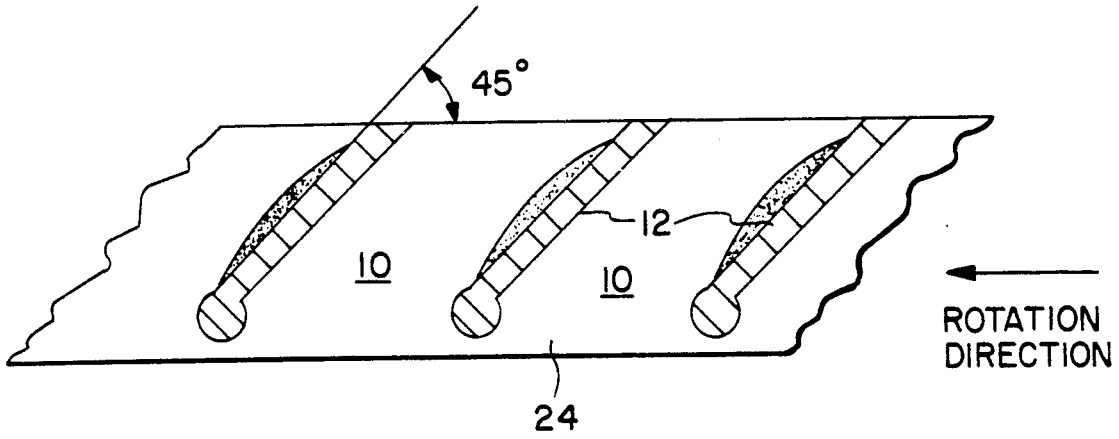
FIG. 6 is an elevational view taken along line 6—6 of FIG. 5.

FIG. 5 shows the outer passage wall (22) being attached and rotated with the grinding table (16). The addition of such a "boxed" passage to the design shown in FIG. 3 will eliminate a region of high velocity resulting from the ⅜ inch clearance gap between the vane edge and the outer passage wall. This will create a more uniform velocity profile across the rotating passage.

Figure 7:
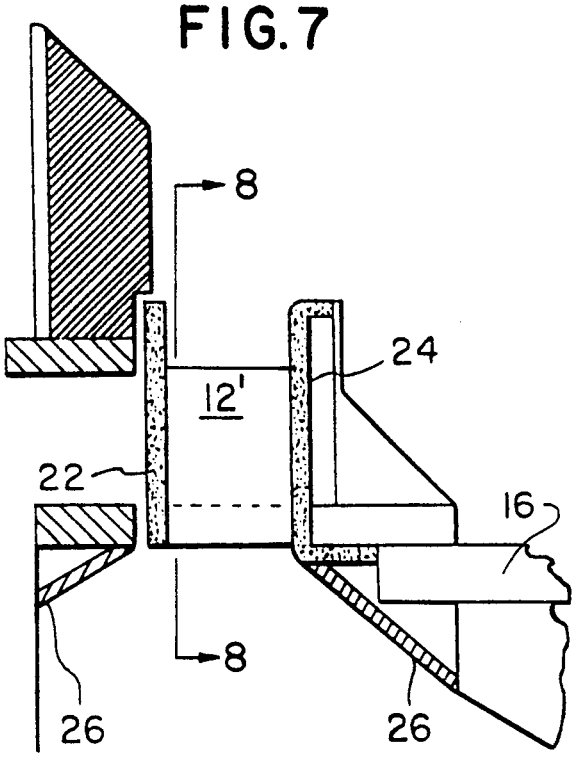
FIG. 7 is a view similar to FIG. 3 showing still further improved features of the present invention.
Figure 8:
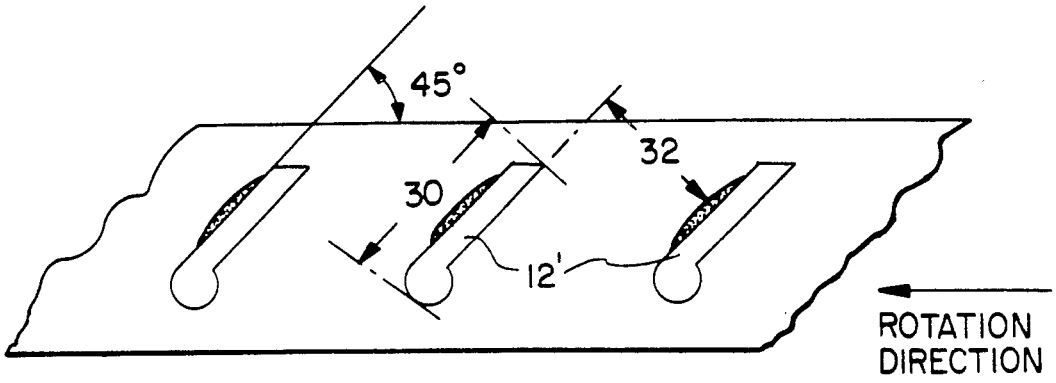
FIG. 8 is an elevational view taken along line 8—8 of FIG. 7.

FIG. 7 shows a shortened vane length design which is approximately one-half the current vane length of three times the minimum perpendicular distance between the vanes as seen in FIG. 2. The advantages of this design are a) reduced friction pressure loss by eliminating unnecessary vane length; b) increasing the inlet passage distance to help promote a more uniform velocity profile; and c) reduction in the passage segment bulk and weight, providing for easier maintenance. Thus, as shown in FIGS. 7 and 8, each vane (12') is only about one half the vertical extent of the passage space between the outer and inner walls (22, 24). The vane length (30) in its angular orientation is also selected to be approximately 1 to 1¾ times and preferable one and one half times the perpendicular spacing between vanes shown at (32) in FIG. 8.

Use of the combined rotating annular passage designs described above provides the following advantages over the current design.

a) Reduction in erosion of mill components such as the roll wheel hubs and the mill wall housing due to vertical inner and outer passage walls, and a reduced horizontal component of velocity exiting the annular passage by way of an increased vane angle.

b) Reduction in energy spent swirling or rotating the coal bed more than necessary for proper mill operation. This is due to the reduction in the horizontal component of velocity by way of an increased vane angle.

c) The reverse vane orientation takes advantage of the fanning effect produced by the annular passage rotation.

d) The increased vane angle results in better utilization of the vertical component of velocity in suspending coal particles.

e) The "boxed" passage and flow contour plates minimize the flow disturbances in and before the annular passage. This leads to a more uniform velocity distribution through the annular passage.

f) Reduction in vane length reduces friction losses as well as component weight.

g) Reduction in vane length, along with the vertical inner and outer walls, provides for easier installation and maintenance.

h) The vertical inner and outer passage make for a less complex casting design, which reduces the probability of manufacturing errors.

Further, although the economic advantages of casting each passage section are known, the new annular passage design of the invention may be manufactured partly or entirely through weld and plate technology.

While specific embodiments of the invention have been shown and described in detail to illustrate the application of the principles of the invention, it will be understood that the invention may be embodied otherwise without departing from such principles.

What is claimed is:

1. An improved annular passage arrangement for a pulverizer, comprising:

a fixed housing having an axis and defining an inlet plenum for air into the pulverizer and a grinding zone where air picks up and conveys articles pulverized in the pulverizer;

a grinding table mounted for rotation about the axis in the housing;

an outer wall in the housing;

an inner wall connected to the table and positioned in the housing, the inner wall being spaced inwardly from the outer wall for defining an annular passage therebetween with said annular passage having a passage inlet and a passage outlet;

a plurality of vanes extending radially between the inner and outer walls for dividing the annular passage into a plurality of circumferentially spaced passage ports between the inner and outer walls, said vanes being parallel to each other and inclined at an acute angle to the horizontal in a direction whereby an inlet end of each vane adjacent the inlet plenum is upstream in the rotation direction of an outlet end of each vane adjacent the grinding zone, each port including an inner inlet end below the grinding table;

an angularly inclined flow contouring plate in the inner and outer portions of the inlet end of each passage port, said angularly inclined flow contouring plate extending below the inlet end of each passage port at an acute angle along a periphery of an entry area for each passage port for contouring air flow from the inlet plenum into each passage port; and the inner and outer walls both being substantially parallel to the axis, said annular passage defined by the inner and outer walls extending vertically and substantially parallel to the axis to provide means for directing passage outlet airflow away from the grinding table.

2. An improved annular passage arrangement according to claim 1, wherein the outer passage wall is fixed to the housing, each vane being fixed to the inner passage wall and extending to within a gap spaced from the outer passage wall.

3. An improved annular passage arrangement according to claim 1, wherein the outer wall is connected to the inner wall through the vanes, and rotates with the grinding table.

4. An improved annular passage arrangement according to claim 1, wherein each vane has a length parallel to the axis which is approximately one half the length of each passage port parallel to the axis, each vane being spaced from an adjacent vane by a maximum perpendicular distance, the length of each vane parallel to its acute angle orientation being from 1 to $1\frac{3}{4}$ times the perpendicular distance between each vane.

5. An improved annular passage arrangement for a pulverizer, comprising:

a fixed housing having an axis and defining an inlet plenum for air into the pulverizer and a grinding zone where air picks up and conveys articles pulverized in the pulverizer;

a grinding table mounted for rotation about the axis in the housing;

an outer wall in the housing;

an inner wall connected to the table and positioned in the housing, the inner wall being spaced inwardly from the outer wall for defining an annular passage therebetween with said annular passage having a passage inlet and a passage outlet;

a plurality of vanes extending radially between the inner and outer walls for dividing the annular passage into a plurality of circumferentially spaced passage ports between the inner and outer walls, said vanes being parallel to each other and inclined at an acute angle to the horizontal in a direction whereby an inlet end of each vane adjacent the inlet plenum is upstream in the rotation direction of an outlet end of each vane adjacent the grinding zone; and the inner and outer walls both being substantially parallel to the rotation axis, said annular passage being defined by the inner and outer walls extending vertically and substantially parallel to the rotation axis to provide means for directing passage outlet airflow vertically and away from the grinding table.

6. An annular passage arrangement according to claim 5, wherein the acute angle is approximately 45°.

7. An annular passage arrangement according to claim 5, wherein each passage port includes an inner inlet end below the grinding table, the annular passage arrangement including inclined flow-contouring plates in the inner and outer portion of the inlet end of each passage port for contouring air flow from the inlet plenum into each passage port.

8. An annular passage arrangement according to claim 5, wherein the outer passage wall is fixed to the housing, each vane being fixed to the inner passage wall and extending to within a gap spaced from the outer passage wall.

9. An annular passage arrangement according to claim 5, wherein the outer wall is connected to the inner wall through the vanes, and rotates with the grinding table.

10. An annular passage arrangement for a pulverizer, comprising:

a fixed housing having an axis and defining an inlet plenum for air into the pulverizer and a grinding zone where air picks up and conveys articles pulverized in the pulverizer;

a grinding table mounted for rotation about the axis in the housing;

an outer wall in the housing;

an inner wall connected to the table and positioned in the housing, the inner wall being spaced inwardly from the outer wall for defining an annular passage therebetween with said annular passage having a passage inlet and a passage outlet;

a plurality of vanes extending radially between the inner and outer walls for dividing the annular passage into a plurality of circumferentially spaced passage ports between the inner and outer walls, said vanes being parallel to each other and inclined at an acute angle to the horizontal in a direction whereby an inlet end of each vane adjacent the inlet plenum is upstream in the rotation direction of an outlet end of each vane adjacent the grinding zone; and the outer wall being connected to the inner wall through the vanes, and rotating with the grinding table, the inner and outer passage walls being substantially parallel to the rotation axis, said annular passage defined by the inner and outer walls extending vertically and substantially parallel to the rotation axis to provide means for directing passage outlet airflow away from the grinding table.

11. An annular passage arrangement according to claim 10, wherein each passage port includes an inner inlet end below the grinding table, the annular passage arrangement including inclined flow-contouring plates in the inner and outer portion of the inlet end of each passage port for contouring air flow from the inlet plenum into each passage port.

12. An annular passage arrangement according to claim 10, wherein each vane has a length parallel to the axis which is approximately one half the length of each passage port parallel to the axis, each vane being spaced from an adjacent vane by a maximum perpendicular distance, the length of each vane parallel to its acute angle orientation being from about 1 to about $1\frac{3}{4}$ times the perpendicular distance between each vane, the outer wall having a length parallel to the axis and being substantially equal to the length of each passage port.

* * * * *